US007987537B1

(12) United States Patent
Hsiao

(10) Patent No.: US 7,987,537 B1
(45) Date of Patent: Aug. 2, 2011

(54) PILLOW STRUCTURE

(75) Inventor: Hsueh-Sheng Hsiao, Jhuci Township, Chiayi County (TW)

(73) Assignee: Chern Shing Top Co., Ltd., Jhuci Township, Chiayi County (TW)

( * ) Notice: Subject to any disclaimer, the term of this patent is extended or adjusted under 35 U.S.C. 154(b) by 0 days.

(21) Appl. No.: 12/938,505

(22) Filed: Nov. 3, 2010

(51) Int. Cl.
*A47G 9/00* (2006.01)

(52) U.S. Cl. ..... 5/630; 5/636; 5/640

(58) Field of Classification Search ..... 5/630, 634, 5/636, 640, 632, 652, 657
See application file for complete search history.

(56) References Cited

U.S. PATENT DOCUMENTS 4,941,478 A * 7/1990 Takeuchi et al. ..... 128/848

* cited by examiner

*Primary Examiner* — Fredrick Conley
(74) *Attorney, Agent, or Firm* — Alan Kamrath; Kamrath & Associates PA

(57) ABSTRACT

A pillow structure substantially has a bottom board 1 mounted at a bottom inside a pillow body 10 and at least one resilient pad 2 controlled by an adjuster 4 mounted on the bottom board 1. By having the resilient pad 2 to support a buffering layer 3 for neck leaning, curved degrees of the pillow body 10 are adjusted corresponding to different users.

4 Claims, 8 Drawing Sheets

PILLOW STRUCTURE

BACKGROUND OF THE INVENTION

1. Field of the Invention

The present invention relates to a pillow structure having a resilient pad pulled by an adjuster mounted interiorly to push a buffering layer to provide support to a user's neck.

2. Description of Related Art

People take one-third of work and rest time for sleeping, and sleeping quality is one important matter for health issues. Except selecting a nice bed, selecting a pillow designed in accordance with body engineering is more important.

Conventional pillows are composed of a buffering layer coated with a pillow cover. Differences of the conventional pillow are only about the different materials of the buffering layer (such as form, silicon rubber, latex rubber, etc.) and the shape variations (shape designed in accordance with body engineering). Although the conventional pillows can provide different comfort by being made of different materials for the buffering layers, the conventional pillows are made by mass production for general demands. Therefore, the conventional pillows cannot provide personal adjustments for different body shapes or features to different users.

Therefore, after using the conventional pillows for a long term, the user's neck usually cannot be well supported or protected and, thus, incurring neck sore or ache problems, so that the user cannot have sufficient rest and will have neck illnesses.

SUMMARY OF THE INVENTION

A main objective of the present invention is to provide a pillow structure that provides adjusting efficiency to different users.

To achieve the foregoing objective, the pillow structure comprises:

a bottom board covered with a buffering layer; and at least one resilient pad mounted on the bottom board and controlled by an adjuster to change a curved degree of the at least one resilient pad and to give support to the buffering layer.

Further benefits and advantages of the present invention will become apparent after a careful reading of the detailed description with appropriate reference to the accompanying drawings.

DETAILED DESCRIPTION OF THE PREFERRED EMBODIMENT

A pillow structure in accordance with the present invention substantially has a bottom board mounted at a bottom inside a pillow body and at least one resilient pad controlled by an adjuster mounted on the bottom board. By having the resilient pad support a buffering layer for neck leaning, the curved degrees of the pillow are adjusted corresponding to different users.

Figure 1:
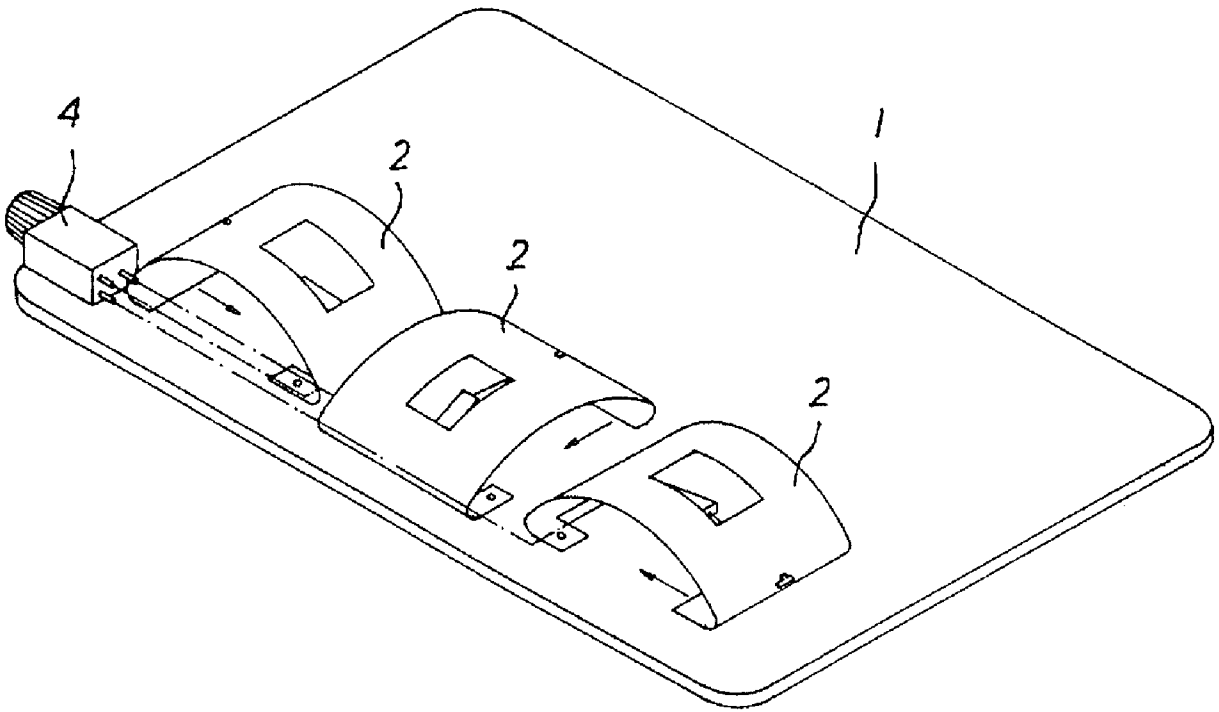
FIG. 1 is a perspective view of a pillow structure in accordance with the present invention.
Figure 2:
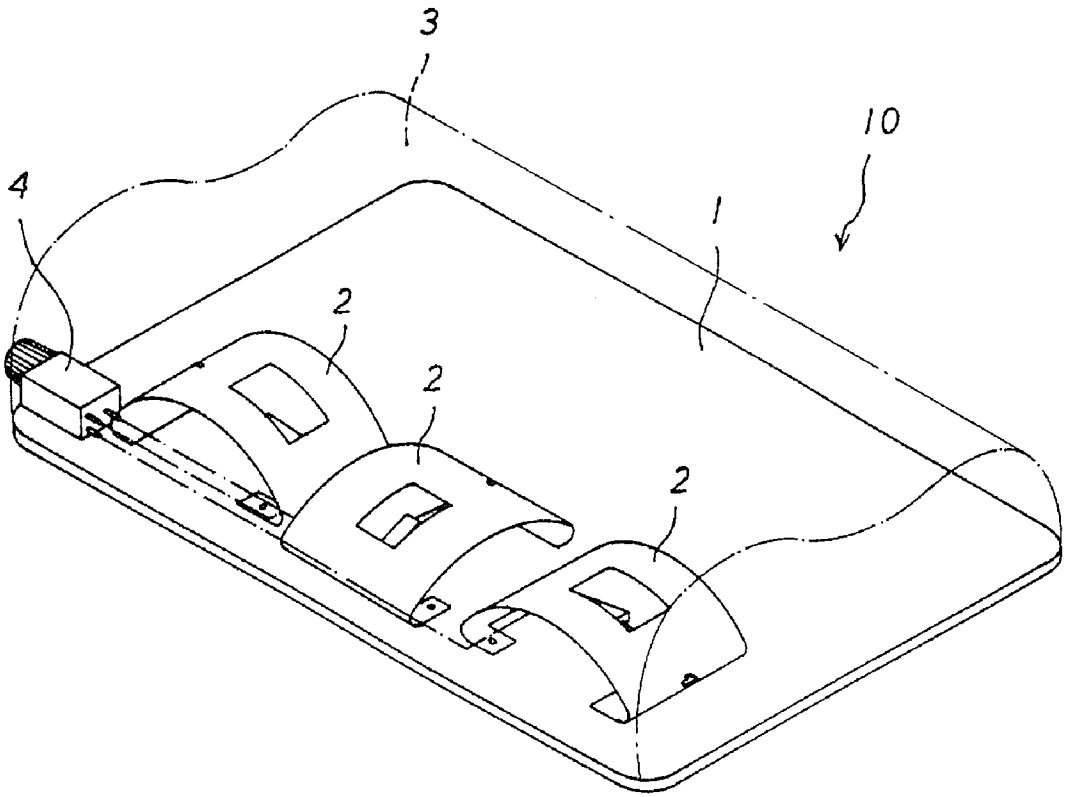
FIG. 2 is a perspective view of the pillow structure attached with a buffering layer.

A pillow structure in the present invention has a bottom board 1 mounted at an interior bottom of a pillow body 10 (as shown in FIGS. 1 and 2) and has an arced resilient pad 2 controlled by an adjuster 4, so that the curved degrees of the pillow body 10 is adjusted corresponding to different users by changing the curved degrees of the resilient pad 2 to give support to a buffering layer 3 of the pillow body 10 for neck leaning.

Figure 3:
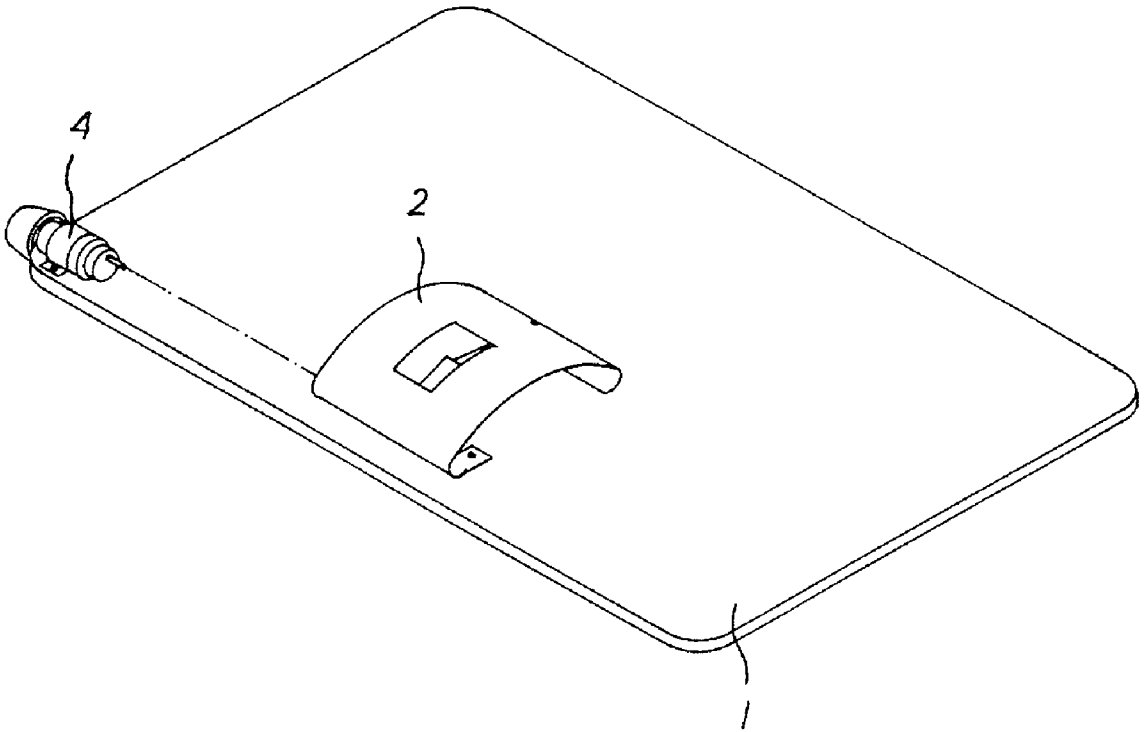
FIG. 3 is a perspective view of one embodiment of the pillow structure in accordance with the present invention.
Figure 4:
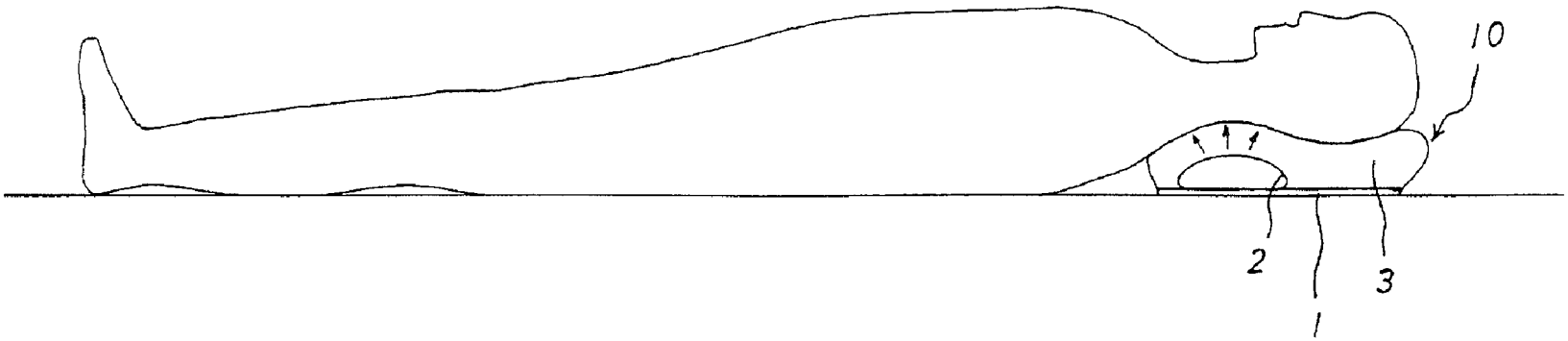
FIG. 4 is an operationally cross-sectional side view of the pillow structure in FIG. 3.

By having the structure described above, one resilient pad 2 is mounted at a center of the bottom board 1 to correspond to a direction of a user's lying direction (as shown in FIG. 3). Two ends of the resilient pad 2 are connected to a guiding wire and controlled by the adjuster 4 (one end of the resilient pad 2 is immovably secured to the bottom board 1 and serves as an fixed end, while another end of the resilient pad 2 is a movable end so that when a length of the guiding wire between the two ends of the resilient pad 2 is changed, the bulged curved degree of the resilient pad 2 is correspondingly changed). Therefore, when the user's neck leans on the pillow body 10, the adjuster 4 operates to make the resilient pad 2 support and push the buffering layer 3. Thus, the bulged height of the buffering layers 3 is suitable for personal usage needs (as shown in FIG. 4) to prevent the user's neck from being suspended or from being in an over-pressed situation and to improve the pillow's comfort.

Figure 5:
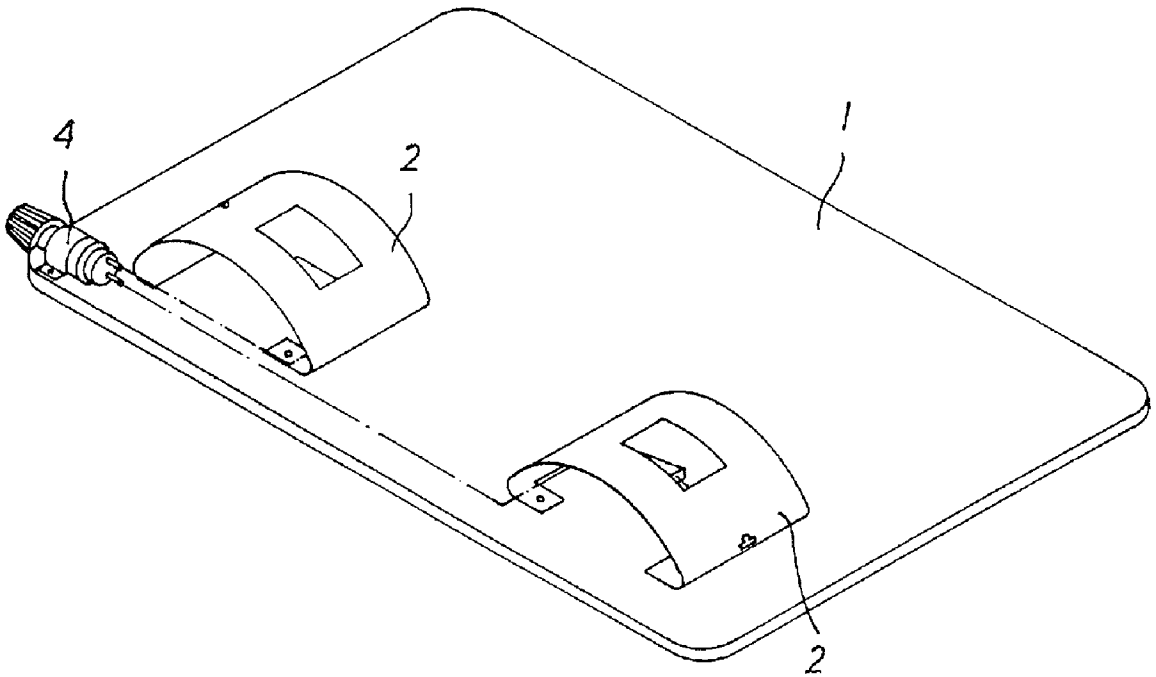
FIG. 5 is a perspective view of another embodiment of the pillow structure in accordance with the present invention.

Moreover, one embodiment of the pillow structure in accordance with the present invention has two resilient pads 2 oppositely mounted at two sides of a bottom board 1 and controlled by an adjuster 4 (as shown in FIG. 5) and located at two sides of a user's neck leaning thereon. By having the two resilient pads 2 at the two sides of the user's neck to bulge the buffering layer 3, the pillow body keeps the user's neck straight and not to be lopsided, to easily achieve protection of the user's neck.

Figure 6:
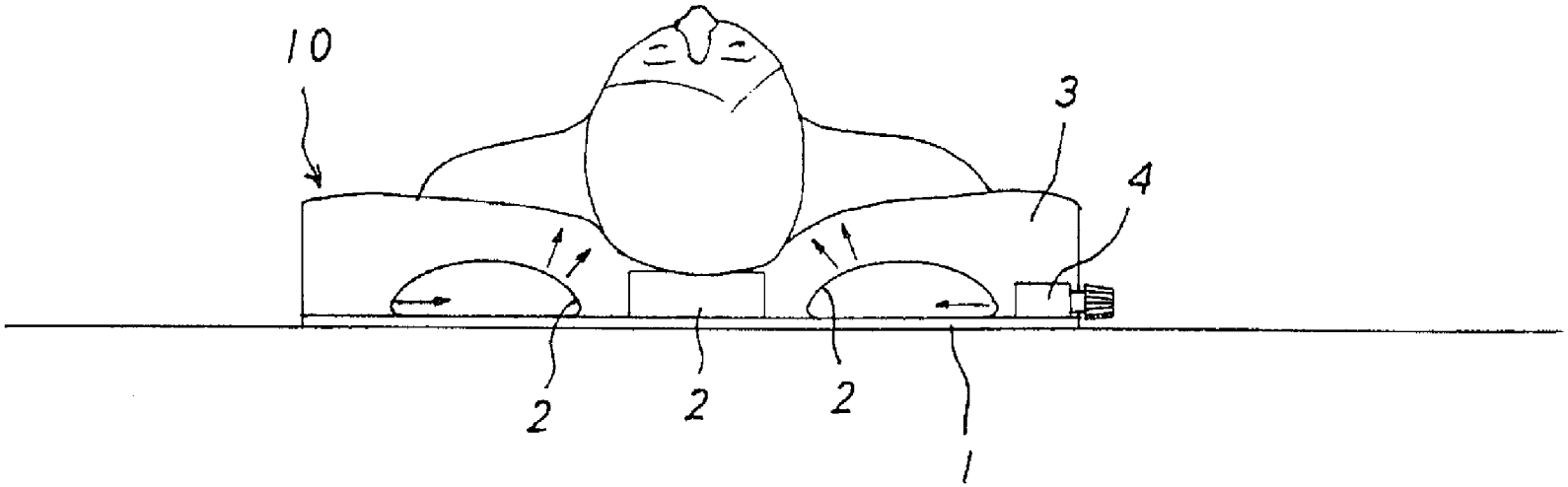
FIG. 6 is an operationally cross-sectional front view of the pillow structure.
Figure 7:
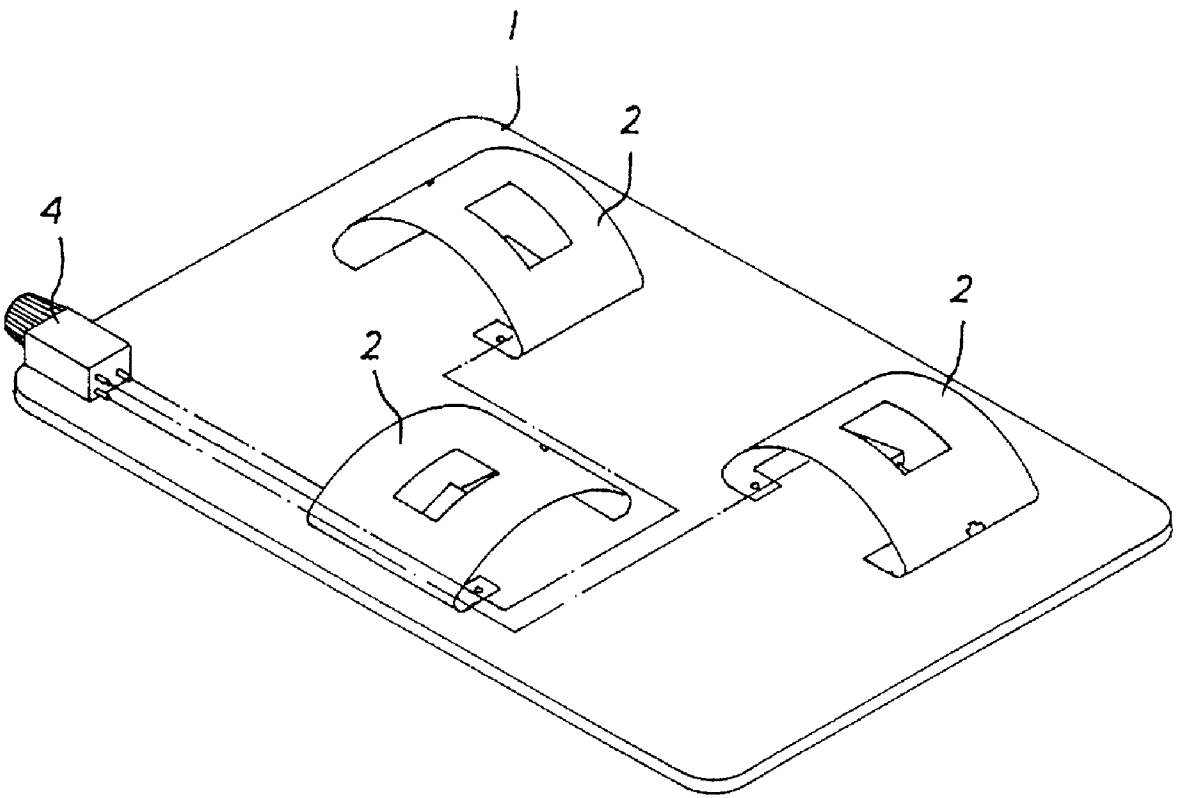
FIG. 7 is a perspective view of still another embodiment of the pillow structure in accordance with the present invention.

Moreover, another embodiment of the pillow structure in accordance with the present invention has one resilient pad 2 mounted at a center of the bottom board 1 and more two resilient pads 2 oppositely mounted at two sides of the bottom board 1. All three resilient pads 2 are controlled by an adjuster 4 (the adjuster 4 is performed by one-axle, one guiding wire; by one-axle, two guiding wires; or by dual-axle, three guiding-wires corresponding to different numbers of the resilient pads 2). By having the resilient pad 2 at the center to push the buffering layer 3 and fully support the user's neck and the two resilient pads 2 at the two sides to keep the user's neck straight (as shown in FIGS. 6 and 7), the pillow structure achieves the complete adjustment functions of body engineering design, has health benefit, and improves the pillow's comfort.

Figure 8:
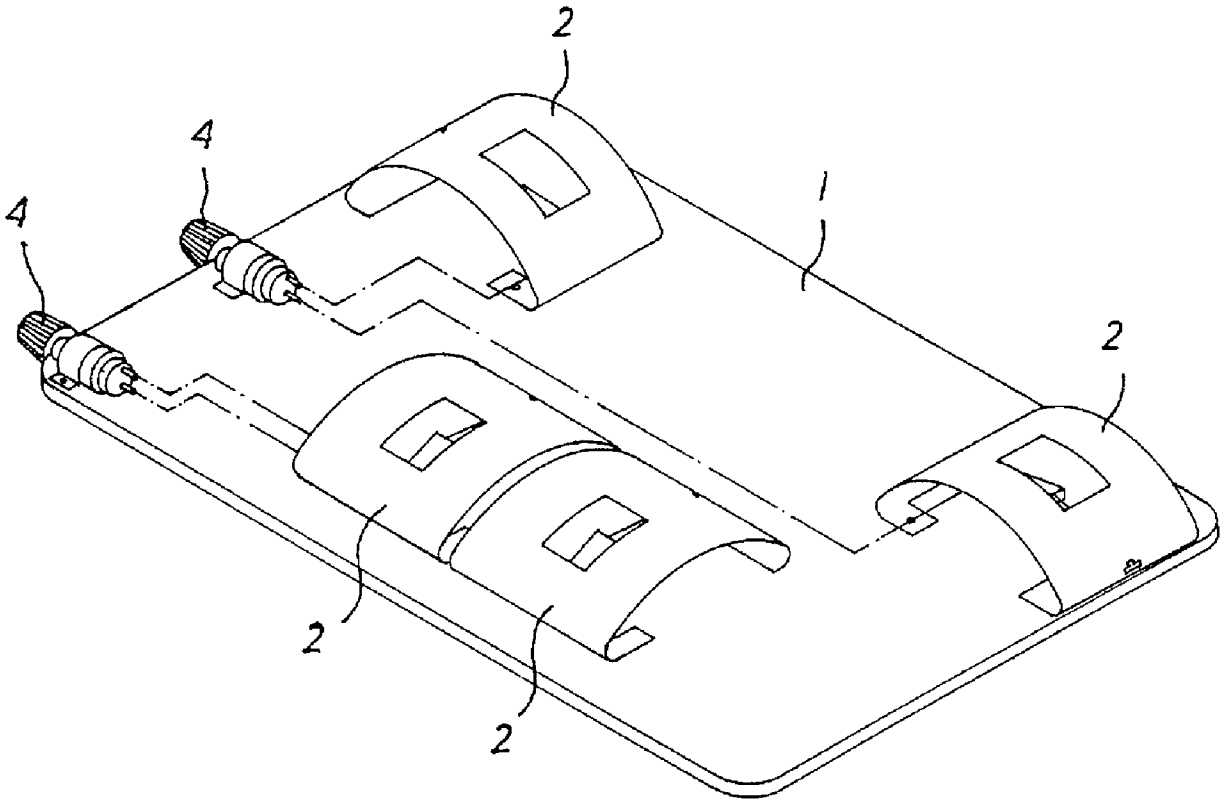
FIG. 8 is a perspective view of still another embodiment of the pillow structure in accordance with the present invention.

According to the above description of the structure, to users having a different size (such as the different sizes of adults or kids), the resilient pad 2 mounted at the center of the bottom board 1 is arranged in a form of multiple units corresponding to the user's lying direction (as shown in FIG. 8) to provide a large-surface and a large supporting force to protect the user's neck.

What is claimed is:

1. A pillow structure comprising:

a bottom board covered with a buffering layer;

at least one resilient pad mounted on the bottom board; and an adjuster controlling the at least one resilient pad to change curved degrees of the at least one resilient pad and to support to the buffering layer, wherein one resilient pad is mounted at a center of the bottom board corresponding to a user's lying direction and two resilient pads are oppositely respectively mounted at two sides of the bottom board, wherein all three resilient pads are controlled by the adjuster.

2. The pillow structure as claimed in claim 1, wherein the two resilient pads oppositely respectfully mounted at two sides of the bottom board are adapted to locate at two sides of a user's neck.

3. A pillow structure comprising:

a bottom board covered with a buffering layer;

at least one resilient pad mounted on the bottom board; and an adjuster controlling the at least one resilient pad to change curved degrees of the at least one resilient pad and to support to the buffering layer, wherein one resilient pad is mounted at a center of the bottom board corresponding to a user's lying direction and is performed in multiple units and two resilient pads are oppositely respectively mounted at two sides of the bottom board, wherein all three resilient pads are controlled by the adjuster.

4. The pillow structure as claimed in claim 3, wherein the two resilient pads oppositely respectfully mounted at two sides of the bottom board are adapted to locate at two sides of a user's neck.

* * * * *